United States Patent [19]

Cerny et al.

[11] 4,381,061

[45] Apr. 26, 1983

[54] NON-PANELING CONTAINER

[75] Inventors: Daryl D. Cerny, Greenville, Ohio; Edwin J. Diebolt, Muncie, Ind.

[73] Assignee: Ball Corporation, Muncie, Ind.

[21] Appl. No.: 266,783

[22] Filed: May 26, 1981

[51] Int. Cl.[3] ..... B65D 23/00

[52] U.S. Cl. ..... 215/1 C; 220/66; 220/70; 220/415

[58] Field of Search ..... 220/66, 67, 70, 415; 215/1 C

[56] References Cited

U.S. PATENT DOCUMENTS

| | | | |
|---|---|---|---|
| D. 248,916 | 8/1978 | Reynolds et al. | D7/15 |
| 2,971,671 | 2/1961 | Shakman | 220/66 |
| 2,982,440 | 5/1961 | Harrison | 220/66 |
| 3,409,167 | 11/1968 | Blanchard | 220/66 |
| 3,870,181 | 3/1975 | Sincock | 215/1 C |
| 4,099,475 | 11/1978 | Lee, Jr. | 29/407 |
| 4,120,419 | 10/1978 | Saunders | 220/66 |
| 4,151,927 | 5/1979 | Cvacho et al. | 220/70 |
| 4,294,373 | 10/1981 | Miller et al. | 220/70 |

*Primary Examiner*—Steven M. Pollard
*Assistant Examiner*—D. Voorhees
*Attorney, Agent, or Firm*—Gilbert E. Alberding

[57] ABSTRACT

This invention relates to a plastic or thermoplastic container designed to exhibit non-paneling of its sidewall due to reduction in pressure within the container. The container itself is provided with a yieldable bottom endwall especially constructed to compensate against the effects of reduced internal pressures often experienced after sealing hot fluids and the like. The thermoplastic container herein described is capable of being filled and sealed without paneling or deformation of its sidewall, said bottom endwall being displaceable inwardly, in preference to the sidewall, upon a relative reduction of pressure in the container, said bottom endwall comprising an outer frustoconical surface extending downwardly and inwardly from said sidewall toward the longitudinal axis of the container at an angle between about 5° and 30°, a curvilinear base integrally connected with and extending downwardly from said outer frustoconical surface and providing a base for said container while resting on a supporting surface, said base being defined by an outer curved portion having a major radius of curvature and an inner curved portion having a minor radius of curvature, the centers of said radii falling on a common line parallel to the longitudinal axis of the container and the radii intersecting one another tangentially, the ratio of said major to minor radii being in the range of about 2:1.

15 Claims, 6 Drawing Figures

NON-PANELING CONTAINER

BACKGROUND OF THE INVENTION

This invention relates to especially designed and novel containers which have special structural features embodied therein for maintaining their sidewall integrity and, in particular, relates to the basal portion of plastic or thermoplastic container bodies that are so constructed so as to compensate against physical as well as chemical effects resulting in deviations in internal pressure after closing or sealing said bodies.

It is known that after filling and sealing a yieldable body such as a thermoplastic container there is a tendency for the sidewall thereof to deform or panel inwardly under certain conditions. This deformation of the sidewall results from deviations in pressure within the interior of the container as compared to the pressure in the exterior thereof and these deviations may be brought about by various physical or chemical conditions. In the packaging of food various materials including fluids such as juices, syrups, salad oils and the like are oftentimes brought to elevated temperatures before introduction into thermoplastic containers. It has been found that there is a marked tendency for such containers to incurve or distort inwardly due to changes in the internal and external pressure of such containers. For example, when hot-fill containers are allowed to cool, the internal pressure will gradually decrease whereby the external atmospheric pressure causes their sidewalls to indent, panel or otherwise partially collapse. Various attempts to rigidify or strengthen the sidewall configuration have been done to compensate for this tendency with various degrees of success.

Aside from the problems associated with such hot-fill containers there are other related packaging situations where chemical reactions cause noticeable reductions in the internal pressures of a container resulting in the paneling or deformation of the sidewall. For example, when lubrication or motor oil is packaged in a plastic container and sealed, chemical reactions take place between the various hydrocarbon constituents and any residual oxygen, e.g., air, causing the total pressure within the container to decrease. With this drop in pressure there results an inward paneling of the sidewall in order to equalize or compensate for the decrease in internal pressure. Here again, as with the hot-fill container, attempts have been made to provide rigidifying structures as well as containers with flexible features or components associated to compensate for this particular problem.

A number of prior art patents are known which relate to container structures that have flexible bottom portions that aid in pressure effects or have bottom endwall portions that appear structurally similar to those described and claimed herein. Although they are closely related, these prior art devices fall short of rendering an effective flexible member having the attributes of the subject invention. U.S. Pat. No. 1,570,732 to Emerson discloses a vacuum indicator device for sealed containers; U.S. Pat. No. 3,160,302 to Chaplin shows a container closure that is able to assume different positions depending upon the pressure conditions; U.S. Pat. No. 3,400,853 to Jacobsen teaches a container for filling hot goods, the container assuming a convex or concave position depending upon differential pressure application thereon; U.S. Pat. No. 4,099,475 and U.S. Pat. No. Des. 248,916 show an endwall structure somewhat similar to that disclosed and claimed herein; U.S. Pat. No. 3,409,167 discloses a container with a flexible bottom endwall structure; U.S. Pat. No. 3,426,939 to Young discloses a preferentially deformable container structure; U.S. Pat. No. 3,434,626 to Kinslow, Jr. teaches a plastic container bottom having increased strength and U.S. Pat. No. 4,134,354 to Cvacho, et al., discloses a metal container having a construction somewhat similar to the subject invention.

It will be appreciated that a paneled or deformed container would not have a desirable appearance from a marketing or consumer point of view. Aside from an undesirable appearance, the container itself loses column strength and sidewall symmetry which presents a problem in nesting or stacking them for storage, display and the like. Since the reduction in internal pressure cannot always be practically avoided, the subject invention provides a novel container configuration wherein a portion of the base of a container compensates or yields as more fully disclosed hereinafter in preference to the sidewall of a container.

The configuration of the container is so designed that it will displace or flex gradually through a series of positional displacements without affecting the integrity of the sidewall thereof. It will be appreciated hereinafter that the sidewalls are not made thicker than the base structure in order to achieve this goal but that the basal portion or the container is designed to flex. Of course, the degree of flexure will depend on the particular configuration of the various elements. In certain situations where chemical reactions continue to take place within a sealed container having entrapped air as, for example, where the air is gradually consumed by chemical reaction with unsaturated portions of the hydrocarbons, the flexing means will incurvate or distend inwardly to compensate for the gradual pressure drop and, as a result, the sidewall goes unaffected or undeformed.

The subject invention relates to an improved container having a non-paneling feature that can be manufactured with conventional machinery employed in thermoforming as well as scrapless forming processes and yet be consistent with strength and other requirements for containers.

Accordingly, an object of this invention is to provide a container body whose particularly designed bottom wall has improved bellowing ability as compared to conventional container structures.

An object of this invention is to provide containers profiled to be capable of preferentially adjusting pressure differences to a predetermined portion of the invention without deforming the sidewall and still rendering excellent serviceability.

Another object of this invention is to provide a configured bottom wall portion for thermoplastic containers that permits the bottom wall thereof to deform inwardly in preference to the sidewall of the container and yet maintain a strength characteristic commensurate to thermoplastic containers formed from relatively thicker stock materials.

Another object of this invention is to provide a plastic container having a configuration that has load-bearing properties substantially in balance with one another.

Still another object of this invention is to provide a container body having a structural design without overly constructing any individual feature thereof, the total structure providing optimum utilization of thermoplastic materials.

Another object of this invention is to provide the art with a yieldable bottom and for a container formed from scrapless forming techniques or thermoforming processes that have equalized or substantially equalized pressure adjusting portions.

A still further object of this invention is to provide the art with a multilayered container having a flexible bottom wall member wherein the container base flexes in preference to the container walls.

Other objects and advantages of this invention will be apparent to those skilled in the art from an inspection of the drawings, description and claims herein.

BRIEF SUMMARY OF THE INVENTION

Briefly, this invention relates to a thermoplastic container capable of being filled and sealed having a yieldable bottom endwall comprising a container having an opening at the upper extremity thereof for receiving a closure, a cylindrical sidewall and a bottom endwall integrally formed with the sidewall at the lower extremity thereof, said bottom endwall being displaceable inwardly, in preference to the sidewall, upon a relative reduction of pressure in the container, said bottom endwall comprising an outer fructoconical surface extending downwardly and inwardly from said sidewall toward the longitudinal axis of the container at an angle less than about 30°, a curvilinear base integrally connected with and extending downwardly from said outer fructoconical surface and providing a base for said container while resting on a supporting surface, said base being defined by an outer curved portion having a major radius of curvature and an inner curved portion having a minor radius of curvature, the centers of said radii falling on a common line parallel to the longitudinal axis of the container and the radii intersecting one another tangentially, the ratio of said major to minor radii being in the range of about 2:1, an annular member extending downwardly and inwardly from said inner curved portion towards the longitudinal axis of the container, a hinge element interconnecting with said inner curved portion and said annular member, said hinge element defining a hinge radius substantially less than the minor radius, said hinge radius being tangent to the minor radius at a point falling on a horizontal line extending from the center of the minor radius, said hinge element being thinner than the sidewall, the hinge element having a thickness less than about 80 percent of the sidewall thickness, the height of said inner curved portion being less than one-half the height of said frustoconical surface, and a central panel connected to said annular member and being slightly above the supporting surface.

DESCRIPTION OF THE PREFERRED EMBODIMENTS

Figure 1:
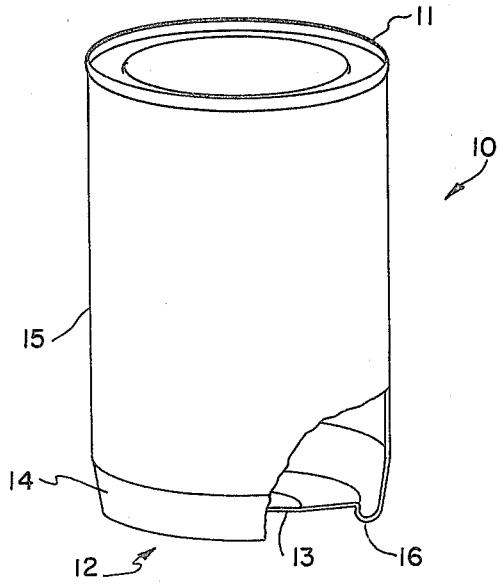
FIG. 1 is an elevational view of a container, constructed in accordance with the present invention, with a cut-away portion showing the bottom endwall in some detail.
Figure 2:
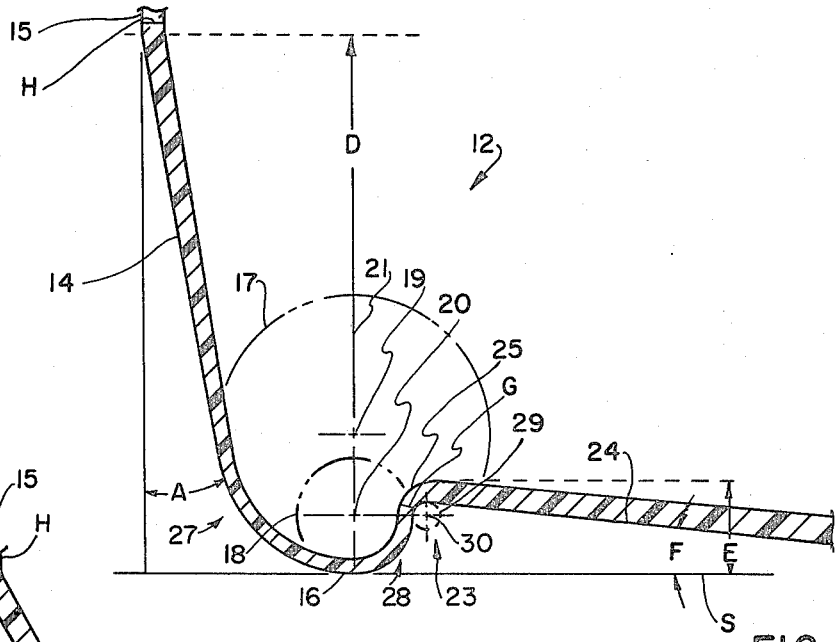
FIG. 2 is a partial cross-sectional view of one embodiment showing a detailed construction of the base portion.
Figure 3:
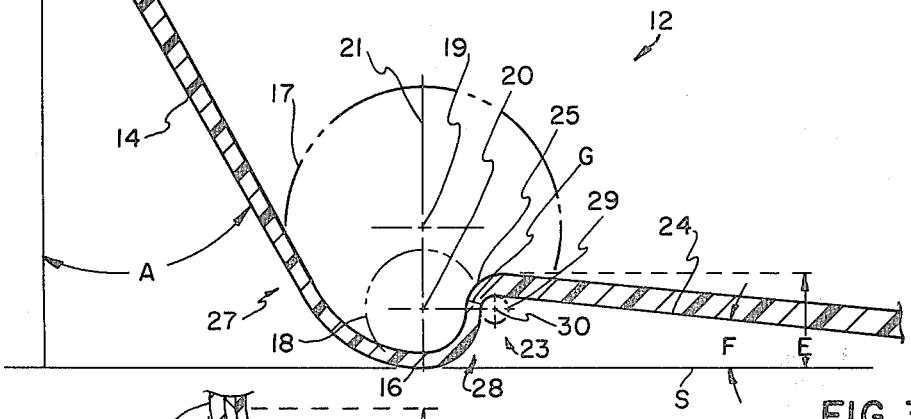
FIG. 3 is another embodiment showing a partial cross-sectional view of the base portion with a somewhat larger angle for the lower base surface.

Referring to the drawings and, in particular, to FIG. 1 thereof, a thermoplastic container 10 is shown, the container being capable of receiving a fluid and sealable by a conventional closure or lid 11. The container 10 is provided with a sidewall 15 and a base 12, the base 12 being flexible or deformable in a fashion as hereinafter described. In general, the movement of the base 12 is caused by a deviation in pressure between the internal and external portions of the container. In particular, this deviation in pressure may be caused by a volume change upon cooling of a heated fluid contained therein or by chemical reactions between any enclosed gas or entrapped air which, in turn, lowers or reduces the internal pressure of the container causing an inward paneling or deformation of the sidewall 15. Any paneling or deformation of the sidewall of a container may be readily prevented, in accordance with the present invention, through a novel combination of constructive elements associated with the base 12 wherein flexing means 13 provide preferential yielding thereof. FIG. 2 shows one embodiment of the invention wherein the base 12 includes such flexing means 13 comprising a frustoconical surface 14 integrally connected to the sidewall 15, said surface 14 being inclined at an angle designated A in FIG. 2. In general, the angle A may be between about 5° and 30°, and preferably about 10°. FIG. 3 shows an embodiment wherein the angel A is about 30° and FIG. 2 wherein angle A is about 10°. It has been found that when angle A is so constructed it can substantially provide strength for vertical load-carrying capacity for the subject container.

The flexing member 13 comprises a curvilinear base 16 integrally connected with and extending from the outer frustoconical surface to provide support for the container 10 while resting on a surface S. The curvilinear base 16 may be divided into two main portions, an outer curved portion 27 and an inner curved portion 28, the outer curved portion 27 having a center of curvature 19 and the inner curved portion 28 having its center of curvature located at 20. In accordance with this invention the relationship between the centers of curvature or radii, 19 and 20, are shown in FIGS. 2 and 3. In particular, the major radius 17 and minor radius 18 both have centers 19 and 20, respectively, that fall on a common line 21 that lie on a line parallel to the longitudinal axis 22 of the container 10. Moreover, it can be seen in FIG. 2 that the radii 17 and 18 intersect one another tangentially and, preferably, have a ratio of major to minor radii of about 2 to 1.

Integrally connected to the curvilinear base 16 is a hinge element 23 defined by a narrowed portion 25 that interconnects the base 16 to an annular member 24. In general, this narrowed portion 25 is thinner than the sidewall 15 by about 80 percent of the sidewall thickness. In a preferred embodiment the narrowed portion 25 should be between about 50 percent to about 65 percent of the sidewall thickness (H). The narrowed portion 25 is readily formed in plastic forming processes where in practice a thermoplastic material is drawn upon or elongated over an edge of a moulding surface which forms the same. It has been found that this elongated or thin portion properly serves to allow better deformation of the base 12 in compensating for changes in pressure. In accordance with this invention the relationship of the hinge element 23 is important in that the hinge element radius 29 is tangent to the minor radius, preferably at a point that falls on a horizontal line normal to the longitudinal axis and extending from the center of the minor radius.

Figure 5:
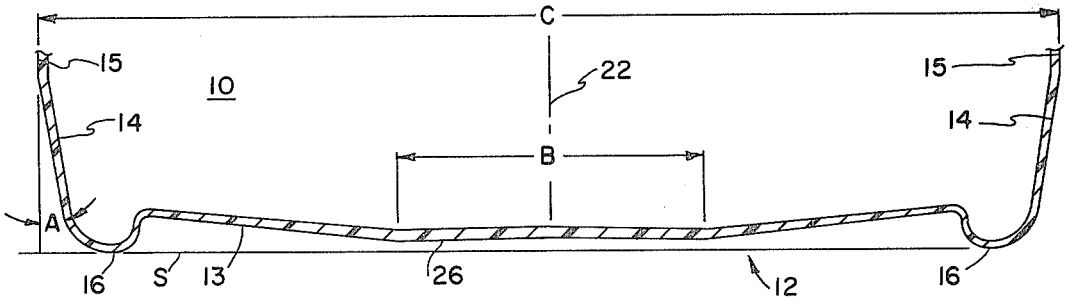
FIG. 5 is a partial cross-sectional view of the subject invention when the container is in an unflexed condition.
Figure 6:
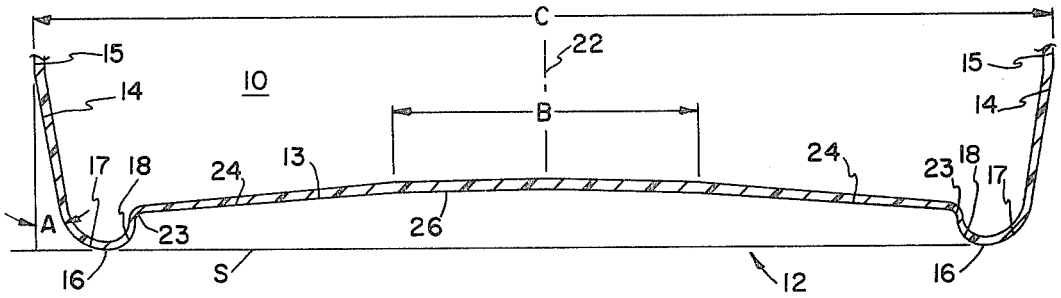
FIG. 6 is a partial cross-sectional view of the container of FIG. 5 when in a full flexed condition.

Integrally connected to the annular member 24 is a central panel 26. The annular member 24 is a downwardly extending section that forms an angle F with the surface S of between about 3° and 8°, preferably about 5°. In a preferred embodiment the diameter B of the central panel 26 is so designed so that it is slightly less than above one-third the diameter C of the container 10. Further, the height of the central panel is such that it is slightly above the supporting surface when unfilled as shown in FIG. 5, and is drawn upwardly above the hinge element in its filled and sealed condition as shown in FIG. 6. It will be appreciated that as the central panel and annular member are drawn upwardly they pass through a central position with respect to the full movement of flexure whereby the stresses are thereafter substantially reversed. In essence, as the central panel and annular member are displaced from the position as shown in FIG. 5 to the position as shown in FIG. 6 a slight lateral movement of the hinge element takes place, which, in effect is a very small increment, that is less than about 15 percent of the average sidewall thickness. This increment of displacement and the thinned section allow movement under relatively slight forces as compared to the conventional containers provided with concentric structures consisting of a plurality of radii or beads that often provide a very rigid basal structure. It has been found that this flexure characteristic along with the other structural features give a highly suitable flexing action for the container herein described.

As regards the height D of the frustoconical surface 14 to that height E of the inner curved surface 28 it is best that the height E be less than one-half that of height D, and preferable about one-fourth thereof. Aside from this relationship it is also an important aspect of this invention that the thermoplastic material be formed to slightly taper downwardly from the sidewall toward the hinge element and that thereafter the material taper or increase slightly in thickness from said element towards the central panel. These particular tapering features are readily accomplished by using moulding surfaces designed or contoured as defined herein.

In use, the thermoplastic container is filled, say with oil or a hot fluid, and sealed with a suitable closure and allowed to cool to ambient temperature. The container as filled assumes a shape as shown in FIG. 5 whereas after cooling or after a period of time the container assumes a shape as shown in FIG. 6. Owing to the reduced pressure the flexible base is drawn inwardly due to the partial vacuum developed incidental to the change in temperature. As a result the integrity of the sidewall is maintained.

The flexing base or endwall is so structured to attain a minimum amount of material required to form the container and maintain standards of useable strength for filling, handling and storage of the filled container. By preventing sidewall paneling under storage conditions the utility and appearance of the container is maintained. The flexible base makes it possible to utilize thinner sidewalls, thereby saving material that would otherwise be required for structural strength. The flexible base is constructed such that the base acts and reacts as a unit in order to retain the rigidity to retain the container contents while being handled without excessive flexing. As the container internal pressure balance changes requiring a decrease in volume, the base endwall moves inwardly to provide for a significant degree of compensation. The structure of the frustoconical surface, curved portion, hinge element, annular member and central panel are shaped so that it is compatible with the normal flow of materials during the container forming process to produce the combination of preferential flexure at the hinge point while retaining sufficient rigidity in the overall structure to provide the desired degree of stability.

The following tabulation of construction parameters is given for a one-quart container (I) and an eight-ounce container (II) in accordance with the subject invention.

| | Container I | Container II |
|---|---|---|
| Container Diameter (C) | 3.960" | 2.635" |
| Container Height (J) | 5.580" | 2.850" |
| Average Sidewall Thickness (H) | 0.030" | 0.030" |
| Frustoconical Angle (A) | 10° | 10° |
| Height of Frustoconical Surface (D) | 0.643" | 0.322" |
| Height of Inner Curved Portion (E) | 0.127" | 0.070" |
| Diameter of Central Panel (B) | 1.250" | 1.000" |
| Annular Member Angle (F) | 6° | 5° |
| Thickness of Hinge Member (G) | 0.019" | 0.019" |
| Av. Endwall Thickness (24 + 26) | 0.037" | 0.037" |
| Major Radius (17) | 0.185" | 0.142" |
| Minor Radius (18) | 0.093" | 0.050" |
| Hinge Radius (29) | 0.034" | 0.020" |

Thermoplastic containers having the above construction characteristics did not exhibit any paneling of the sidewall after being filled and sealed with motor oil or fruit juice.

Figure 4:
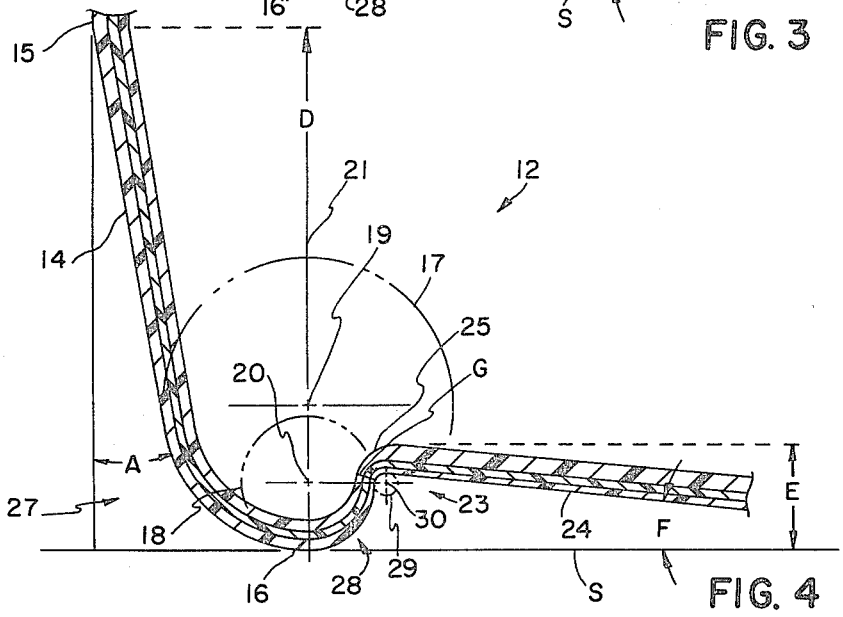
FIG. 4 is a detailed cross-sectional view of still another embodiment similar to FIG. 2 but having a multilayered structure.

The thermoplastic material herein used to form the non-paneling containers may vary over a wide range. In general, the invention is applicable to a single plastic material such as polyolefin, including polyethylene, polypropylene, etc., and polyvinyl aromatics such as polyesters, polystyrenes, as well as polyvinyl halides such as polyvinyl chlorides. All these materials may be used to form open-mouth containers as described herein and may, in addition, be readily used to form multilayered articles. For example, a multilayered material may consist of polyvinyl aromatics such as styrene, polyvinyl toluene, a rubber modified blends thereof with a core of saran or polyvinylidene chloride. A further useful layered structure may consist of polyethylene or polypropylene with a core of polvinylidene chloride. Containers formed with a polyvinylidene chloride layer are excellent barriers to gases such as oxygen, carbon dioxide and the like. Referring to FIG. 4 there is shown a multilayered, flexible endwall structure in cross-section that can be produced by scrapless forming techniques using coextruded stock. When containers are contoured in accordance with the subject invention they have improved strength characteristics and function well as non-paneling containers.

It will be appreciated that the polymeric materials may be both unoriented and oriented. Unoriented thermoplastic containers may be formed by processes including thermoforming, injection molding or blow molding whereas oriented thermoplastic containers may be readily formed by scrapless forming techniques, solid-phase forming or conventional stretch and blow processes. In these later categories of processing a considerable degree of orientation is built into a given container.

The embodiments of this invention disclosed in the drawings and specification are for illustrative purposes only, and it is to be expressly understood that said drawing and specification are not to be construed as a definition of the limits or scope of the invention, reference being made to the appended claims for that purpose.

What is claimed is:

1. A thermoplastic container capable of being filled and sealed having a yieldable bottom endwall comprising a container having an opening at the upper extremity thereof for receiving a closure, a cylindrical sidewall and a bottom endwall integrally formed with the sidewall at the lower extremity thereof, said bottom endwall being displaceable inwardly, in preference to the sidewall, upon a relative reduction of pressure in the container, said bottom endwall comprising a frustoconical surface extending downwardly and inwardly from said sidewall toward the longitudinal axis of the container at an angle less than about 30°, a curvilinear base integrally connected with and extending downwardly from said frustoconical surface and providing a base for said container while resting on a supporting surface, said base defined by an outer curved portion having a major radius of curvature and an inner curved portion having a minor radius of curvature, the centers of said radii falling on a common line parallel to the longitudinal axis of the container and the radii intersecting one another tangentially, the ratio of said major to minor radii being about 2:1, an annular member extending downwardly and inwardly from said inner curved portion to the axis of the container, a hinge element interconnecting with said inner curved portion and said annular member, said hinge element defining a hinge radius substantially less than the minor radius, said hinge radius being tangent to the minor radius at a point falling on a horizontal line extending from the center of the minor radius, said hinge element being thinner than the sidewall, the wall thickness of hinge element being about 80 percent or less of the sidewall thickness, the height of said inner curved portion being less than one-half the height of said frustoconical surface, and a central panel connected to said annular member and being slightly above the supporting surface.

2. A container as recited in claim 1 wherein the hinge element comprises an elongated neck portion interconnecting said inner curved portion and said annular member.

3. A container as recited in claim 1 wherein the angle of said frustoconical surface is about 10°.

4. A container as recited in claim 1 wherein the annular member extends at an angle of about 6° to the supporting base.

5. A container as recited in claim 1 wherein the thickness of the hinge element is less than about 65 percent of the sidewall.

6. A container as recited in claim 1 wherein the hinge radius is about one-third the minor radius.

7. A container as recited in claim 1 wherein the height of the inner curved portion is about one-fourth the height of said frustoconical surface.

8. A thermoplastic container as recited in claim 1 wherein the container sidewall and endwall comprise coextruded multilayered thermoplastic materials.

9. A container as recited in claim 8 wherein one of the materials is saran.

10. A thermoplastic container capable of being filled and sealed having a yieldable bottom endwall comprising a container having an opening at the upper extremity thereof for receiving a closure, a cylindrical sidewall and a bottom endwall integrally formed with the sidewall at the lower extremity thereof, said bottom endwall being displaceable inwardly, in preference to the sidewall, upon a relative reduction of pressure in the container, said bottom endwall comprising a frustoconical surface extending downwardly and inwardly from said sidewall toward the longitudinal axis of the container at an angle of about 10°, a curvilinear base integrally connected with and extending downwardly from said frustoconical surface and providing a base for said container while resting on a supporting surface, said base defined by an outer curved portion having a major radius of curvature and an inner curved portion having a minor radius of curvature, the centers of said radii falling on a common line parallel to the longitudinal axis of the container and radii intersecting one another tangentially, the ratio of said major to minor radii being about 2:1, an annular member extending downwardly and inwardly from said inner curved portion to the axis of the container, said member extending downwardly at an angle of about 6° to the supporting surface, a hinge element interconnecting with said inner curved portion and said annular member, said hinge element defining a hinge radius substantially less than the minor radius, said hinge radius being tangent to the minor radius at a point falling on a horizontal line extending from the center of the minor radius, said hinge radius being about one-third the minor radius, said hinge element being thinner than the sidewall, the wall thickness of the hinge element being about 80 percent or less of the sidewall thickness, the height of said inner curved portion being less than one-half the height of said frustoconical surface, and a central panel connected to said annular member and being slightly above the supporting surface.

11. A container as recited in claim 10 wherein the container sidewall and endwall comprise coextruded multilayered thermoplastic materials.

12. A container as recited in claim 11 wherein one of the materials is saran.

13. A multilayered thermoplastic container capable of being filled and sealed having a flexible bottom endwall comprising a container having an opening at the upper extremity thereof for receiving a closure, a cylindrical sidewall and a bottom endwall integrally formed with the sidewall at the lower extremity thereof, said bottom endwall being displaceable inwardly, in preference to the sidewall, upon a relative reduction of pressure in the container, said bottom endwall comprising a frustoconical surface extending downwardly and inwardly from said sidewall toward the longitudinal axis of the container at an angle of about 10°, a curvilinear base integrally connected with and extending downwardly from said frustoconical surface and providing a base for said container while resting on a supporting surface, said base defined by an outer curved portion having a major radius of curvature and an inner curved portion having a minor radius of curvature, the centers of said radii falling on a line parallel to the longitudinal axis of the container and the radii intersecting one another tangentially, the ratio of said major to minor radii being about 2:1, an annular member extending downwardly and inwardly from said inner curved portion to the axis of the container, a hinge element interconnecting with said inner curved portion and said annular member, said hinge element defining a hinge radius substantially less than the minor radius, said hinge radius being tangent to the minor radius at a point falling on a horizontal line extending from the center of the minor radius, said hinge element being thinner than the sidewall by an amount less than about 65 percent thereof, the height of said inner curved portion being less than one-third the height of said frustoconical surface, and a central panel connected to said annular member and being slightly above the supporting surface, the ratio of the diameter of the central panel to the diameter of the container is about 1:3.

14. A container as recited in claim 13 wherein the ratio of the height of said frustoconical surface to the height of container is between about 1:7 to 1:10.

15. A container as recited in claim 14 wherein the ratio of the height of said frustoconical surface to the height of the container is between about 1:8 to 1:9.

* * * * *